US006609285B1

(12) United States Patent
Kinney

(10) Patent No.: US 6,609,285 B1
(45) Date of Patent: Aug. 26, 2003

(54) PROCESS FOR MANUFACTURING A SUPPORT

(75) Inventor: Daniel Roland Kinney, Grand Haven, MI (US)

(73) Assignee: Herman Miller, Inc., Zeeland, MI (US)

( * ) Notice: Subject to any disclaimer, the term of this patent is extended or adjusted under 35 U.S.C. 154(b) by 46 days.

(21) Appl. No.: 09/676,316

(22) Filed: Sep. 29, 2000

Related U.S. Application Data

(60) Provisional application No. 60/156,999, filed on Oct. 1, 1999, and provisional application No. 60/159,126, filed on Oct. 12, 1999.

(51) Int. Cl.[7] ..... B21D 39/02

(52) U.S. Cl. ..... 29/407.05; 29/505; 72/379.2

(58) Field of Search ..... 29/897, 407.01, 29/407.05, 505; 72/404, 379.2; 312/196, 223.6; 108/50.02

(56) References Cited

U.S. PATENT DOCUMENTS

| | | | | |
|---|---|---|---|---|
| D31,600 | S | | 10/1899 | Terry |
| 1,833,043 | A | * | 11/1931 | Sheldon ..... 72/379.2 |
| 2,115,441 | A | * | 4/1938 | Black ..... 29/897.35 |
| 2,233,719 | A | * | 3/1941 | Vanderveld ..... 29/897 |
| D150,315 | S | | 7/1948 | Richards |
| 3,862,785 | A | | 1/1975 | Scheerhorn et al. |
| 3,911,549 | A | | 10/1975 | Herr |
| 3,920,299 | A | | 11/1975 | Propst et al. |
| 4,052,872 | A | | 10/1977 | Herr |
| 4,148,203 | A | | 4/1979 | Farazandeh et al. |
| 4,325,597 | A | | 4/1982 | Morrison |
| 4,486,841 | A | | 12/1984 | Koyama et al. |
| 4,586,759 | A | | 5/1986 | Wrobel |
| 4,699,067 | A | | 10/1987 | Okopny |
| 4,714,028 | A | | 12/1987 | Uredat-Neuhoff |
| 4,716,841 | A | | 1/1988 | Suttles |
| 4,734,971 | A | | 4/1988 | Dupasquier |

(List continued on next page.)

FOREIGN PATENT DOCUMENTS

| | | | | |
|---|---|---|---|---|
| JP | 355103230 | A | * 8/1980 | ..... 72/379.2 |

OTHER PUBLICATIONS

"Advanced Office Furniture" literature, published by The Marvel Group, while the publication date is unknown the literature is believed to have been available to the public prior to May 28, 1998, pp. 1–17.

"Arlink Series 8000" literature, published by Arbell Industries, while the publication date is unknown the literature is believed to have been available to the public prior to May 28, 1998, pp. 1–32.

(List continued on next page.)

*Primary Examiner*—Gregory Vidovich
*Assistant Examiner*—Jermie E. Cozart
(74) *Attorney, Agent, or Firm*—Brinks Hofer Gilson & Lione

(57) ABSTRACT

A process for forming a support that includes providing a blank with a first edge and a second edge and forming a first wing at the first edge and a second wing at the second edge. The first wing is folded toward the second wing and attached thereto.

12 Claims, 13 Drawing Sheets

U.S. PATENT DOCUMENTS

| | | | | | |
|---|---|---|---|---|---|
| 4,755,010 | A | | 7/1988 | Wilson et al. | |
| 4,819,467 | A | | 4/1989 | Graf et al. | |
| 4,874,027 | A | | 10/1989 | Boundy et al. | |
| 4,879,800 | A | | 11/1989 | Rumman | |
| 4,882,453 | A | | 11/1989 | Chelsea | |
| 4,884,513 | A | | 12/1989 | Newhouse et al. | |
| 4,914,873 | A | | 4/1990 | Newhouse | |
| 5,024,167 | A | | 6/1991 | Hayward | |
| 5,048,698 | A | | 9/1991 | Konrad | |
| 5,058,269 | A | | 10/1991 | May | |
| D321,447 | S | | 11/1991 | Newhouse | |
| 5,083,512 | A | | 1/1992 | Newhouse et al. | |
| 5,092,253 | A | | 3/1992 | Grund et al. | |
| 5,094,174 | A | | 3/1992 | Grund et al. | |
| 5,103,741 | A | | 4/1992 | Grund et al. | |
| D330,302 | S | | 10/1992 | Heidmann | |
| 5,154,126 | A | | 10/1992 | Newhouse et al. | |
| 5,155,955 | A | | 10/1992 | Ball et al. | |
| 5,160,188 | A | | 11/1992 | Rorke et al. | |
| 5,163,225 | A | * | 11/1992 | Goleby | 29/897 |
| 5,183,319 | A | | 2/1993 | Pearson et al. | |
| 5,187,959 | A | | 2/1993 | Davi | |
| 5,207,041 | A | | 5/1993 | Wills | |
| 5,220,871 | A | | 6/1993 | Grund et al. | |
| 5,226,705 | A | | 7/1993 | Rorke et al. | |
| 5,237,935 | A | | 8/1993 | Newhouse et al. | |
| 5,253,595 | A | | 10/1993 | Heidmann | |
| 5,287,666 | A | | 2/1994 | Frascaroli et al. | |
| 5,309,686 | A | | 5/1994 | Underwood et al. | |
| 5,318,259 | A | | 6/1994 | Fussler | |
| 5,319,951 | A | | 6/1994 | Da Ré | |
| 5,322,025 | A | | 6/1994 | Sherman et al. | |
| D352,406 | S | | 11/1994 | Scheffers | |
| 5,394,658 | A | | 3/1995 | Schreiner et al. | |
| 5,394,809 | A | | 3/1995 | Feldpausch et al. | |
| 5,429,431 | A | | 7/1995 | Olson et al. | |
| 5,544,593 | A | | 8/1996 | Canfield et al. | |
| 5,606,920 | A | | 3/1997 | Meyer et al. | |
| 5,628,114 | A | * | 5/1997 | Stern | 72/379.2 |
| 5,692,405 | A | | 12/1997 | Kirii | |
| 5,747,693 | A | * | 5/1998 | Abbate et al. | 29/407.01 |
| 5,819,578 | A | * | 10/1998 | Codatto | 72/379.2 |
| D427,823 | S | | 7/2000 | Schacht et al. | |
| 6,098,435 | A | * | 8/2000 | Takada | 72/379.2 |
| D439,084 | S | | 3/2001 | Schacht et al. | |

OTHER PUBLICATIONS

Atlantic Furniture Systems literature, published by Atlantic Furniture, while the publication date is unknown the literature is believed to have been available to the public prior to May 28, 1998, 9 pages of materials.

"Context Freestanding Furniture System" literature, published by Steelcase, while the publication date is unknown the literature is believed to have been available to the public prior to May 28, 1998, 61 pages of materials.

"Ellipse Desk System" literature, published by Steelcase, while the publication date is unknown the literature is believed to have been available to the public prior to May 28, 1998, 36 pages of materials.

"Ellipse Desk System NeoCon 97" literature, published by Steelcase, while the publication date is unknown the literature is believed to have been available to the public prior to May 28, 1998, 33 pages of materials.

"ErgoData" literature, published by Precision Mfg., while the publication date is unknown the literature is believed to have been available to the public prior to May 28, 1998, 1 page of materials.

"Espace Temps" literature, published by Sansen, while the publication date is unknown the literature is believed to have been available to the public prior to May 28, 1998, 28 pages of materials.

"Generation II" literature, published by Tiffany Office Furniture, while the publication date is unknown the literature is believed to have been available to the public prior to May 28, 1998, 40 pages of materials.

"Strategy" literature, published by Kimball, 1994, 18 pages of materials.

"Tango Desking System" literature, published by Haworth, while the publication date is unknown the literature is believed to have been available to the public prior to May 28, 1998, 19 pages of materials.

"The Unicell Flexible Laboratory Furniture System" literature, published by Unicell, May, 1989, 4 pages of materials.

"Velocity System" literature, published by Rosemount Office Systems, 1993, 12 pages of materials.

"WorkZone—Great Solutions at Affordable Prices" literature, published by Krueger, while the publication date is unknown the literature is believed to have been available to the public prior to May 28, 1998, 28 pages of materials.

* cited by examiner 112
114
116
118
120
122
124
126
132
134
136
138
θ

PROCESS FOR MANUFACTURING A SUPPORT

Applicant claims, under 35 U.S.C. § 119(e), the benefit of priority of the filing date of Oct. 1, 1999, of U.S. Provisional Patent Application Serial No. 60/156,999 filed on the aforementioned date, the entire contents of which are incorporated herein by reference. Applicant also claims, under 35 U.S.C. § 119(e), the benefit of priority of the filing date of Oct. 12, 1999, of U.S. Provisional Patent Application Serial No. 60/159,126 filed on the aforementioned date, the entire contents of which are incorporated herein by reference.

BACKGROUND OF THE INVENTION

1. Field of the Invention

The present invention relates to a system and process for manufacturing a support, such as a stanchion for a modular desk.

2. Discussion of Related Art

It is known from U.S. Pat. No. 2,115,441 that a rectangular tubular structure can be formed from sheet metal by performing a series of pressings of the sheet metal by a variety of dies. It is also possible to form other tubular structures with a greater number of right angle bends.

One disadvantage of such a system is that it requires a large number of strikes by the break die and is limited to forming tubes with non-angled edges.

SUMMARY OF THE INVENTION

One aspect of the present invention regards a process for forming a support that includes providing a blank with a first edge and a second edge and forming a first wing at the first edge and a second wing at the second edge. The first wing is folded toward the second wing and attached thereto.

The present invention provides significant advantages over other desk systems. For example, the present invention reduces the number of strikes by a break die and provides an efficient way of manufacturing a stanchion with an angled side.

The present invention, together with further objects and advantages, will be best understood by reference to the following detailed description taken in conjunction with the accompanying drawings.

DETAILED DESCRIPTION OF THE PREFERRED EMBODIMENTS

Figure 1:
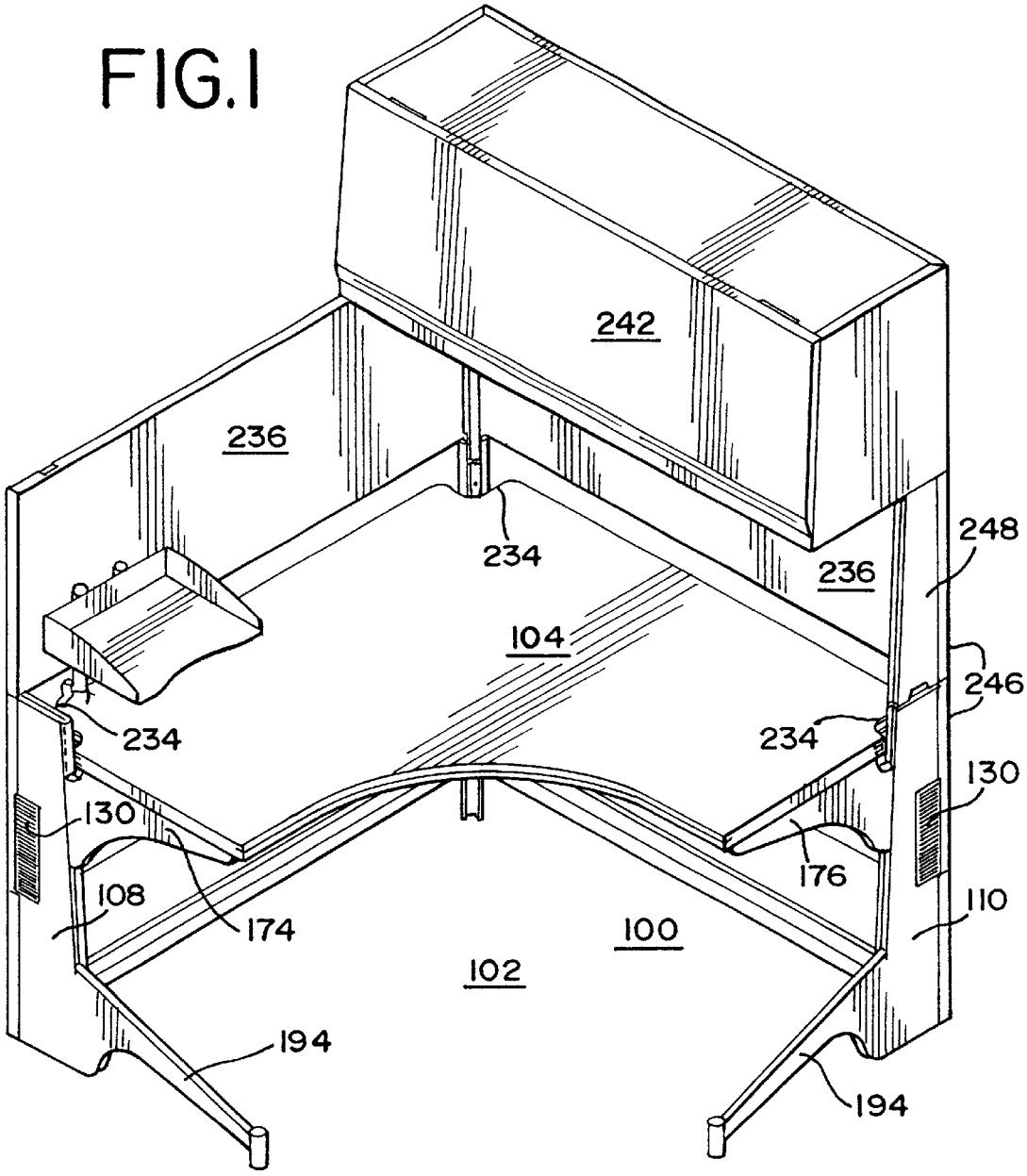
FIG. 1 is a perspective view of a modular desk that employs a stanchion that is manufactured by a system and process according to the present invention.
Figure 2:
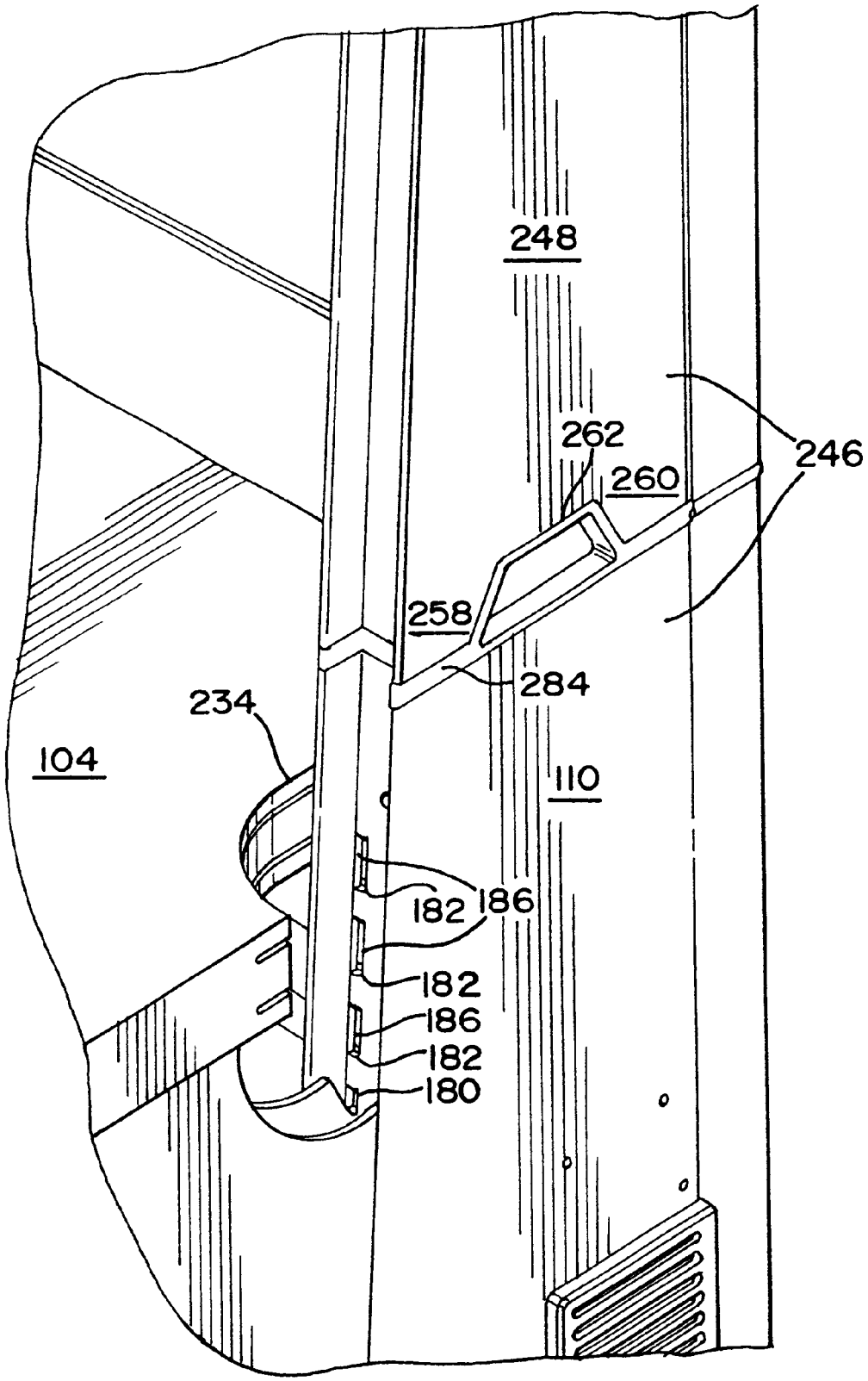
FIG. 2 is a partial side perspective view of the modular desk of FIG. 1.

Referring to the drawings, FIGS. 1 and 2 show an embodiment of a modular desk 100 that employs a pair of side stanchions 108 and 110 and a corner stanchion 197 that are formed by a system and process to be explained below. The modular desk 100 is positioned on a floor 102. The modular desk 100 has a planar worksurface member 104 that is made of a durable material such as high pressure laminate, medium density particle board or medium density veneer.

The worksurface member 104 is L-shaped where one section of the member 104 has a length of approximately 42 inches or 48 inches and the section perpendicular thereto has a length of approximately 60, 66, 72 or 78 inches. Of course, the lengths of the two sections can be equal. The two stanchions 108 and 110 are positioned through the openings 234 of the worksurface member 104 and a corner stanchion 197 is positioned through an interior rear opening 234 of the member 104.

Figures 3, 4, 5, 6, 7, 8, 9:
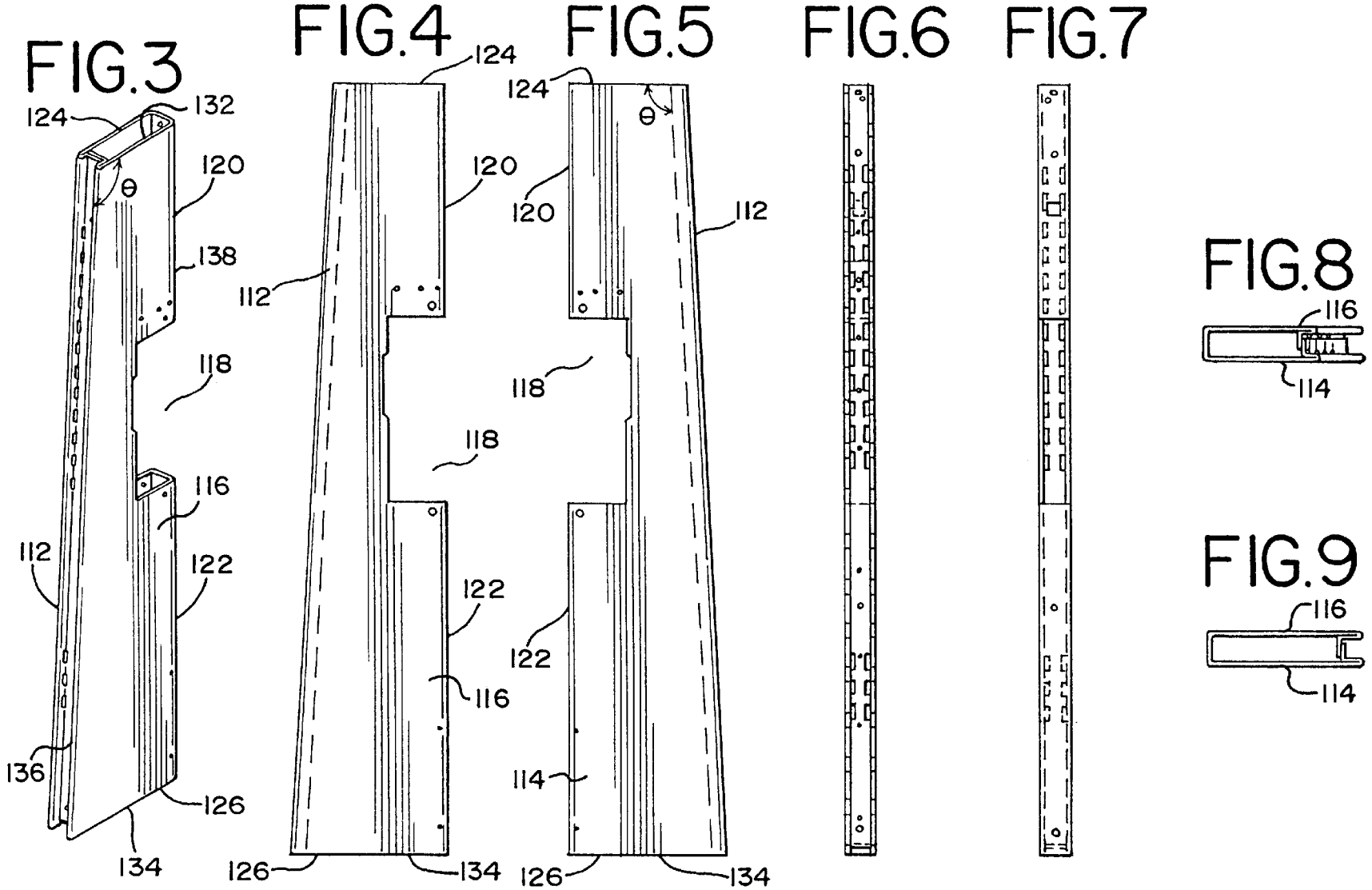
FIG. 3 is a perspective view of a floor stanchion that is used with the modular desk of FIG. 1 and is manufactured by a system and process according to the present invention.
FIG. 4 is a left side view of the floor stanchion of FIG. 3.
FIG. 5 is a right side view of the floor stanchion of FIG. 3.
FIG. 6 is a front view of the floor stanchion of FIG. 3.
FIG. 7 is a rear view of the floor stanchion of FIG. 3.
FIG. 8 is a top view of the floor stanchion of FIG. 3.
FIG. 9 is a bottom view of the floor stanchion of FIG. 3.

The floor stanchion 108 has a shape that is identical to that of the floor stanchion 110. Accordingly, the description to follow regarding stanchion 108 is equally applicable to stanchion 110. As shown in FIGS. 3, 8 and 9, the floor stanchion 108 has a U-shaped front surface 112 that is integrally attached to an interior side wall 114 and an exterior side wall 116 that are parallel to one another and separated from one another by approximately 1.125 inches. Each sidewall 114 and 116 is identical in shape with an opening 118 formed in the rear portion of the sidewall. An upper rear wall 120 is attached to the side walls 114 and 116 and extends to the top edge of the opening, while a lower rear wall 122 is attached to both of the side walls 114 and 116 and extends from the lower edge of the opening 118. A top stanchion surface 124 is integrally attached to the front surface 112, the sidewalls 114, 116 and the upper rear wall 120. Similarly, a bottom stanchion surface 126 is integrally attached to the front surface 112, the sidewalls 114, 116 and the lower rear wall 122. The top stanchion surface 124 is approximately rectangular in shape having a length of approximately 4.25 inches and a width of approximately 1.125 inches. The bottom stanchion surface 126 is parallel to the top stanchion surface 124 and is rectangular in shape having a length of approximately 6.1 inches and a width of approximately 1.125 inches. The bottom stanchion surface 126 preferably has a threaded opening to receive a threaded bolt of an adjustable floor support 128 where rotation of the threaded bolt results in raising or lowering the floor stanchion relative to the floor 102.

The opening 118 is approximately rectangular in shape with a height of approximately 7.125 inches and a width of approximately 2.125 inches. The lower edge of the opening 118 is positioned approximately 13.6 inches above the floor 102 so as to be aligned with cable and wire management structure associated with the modular desk 100.

The edges of a trapezoid are defined by the side edges of the sidewall 116 and the cover 130. In particular, the trapezoid has a top edge 132 that has a length of approximately 4.3 inches, a base 134 having a length of approximately 6.1", a front edge 136 having a length of approximately 29.94 and a rear edge 138 having a length of approximately 29.88 inches. As shown in FIGS. 3–4, the front surface 112 and the front edge 136 are angled relative to the top stanchion surface 124 by an obtuse angle 2 that is approximately 93.5°. Furthermore, the edges of the rear walls 120, 122 and the cover 130 and the rear edge 138 are approximately perpendicular to the top and bottom stanchion surfaces 124, 126.

As explained in U.S. Provisional Patent Application 60/086,991, filed on May 28, 1998 and PCT Patent Application No. PCT/US99/11105, filed on May 19, 1999, the entire contents of both of which are hereby incorporated herein by reference, the stanchions 108, 110 each have openings for passing cable and wiring between adjacent modular desks unless prevented by covers 130. The stanchions 108 and 110 are supported on the floor 102 by leg supports 194 that are attached to the stanchions 108 and 110 by inserting hooked portions into lower slots formed in the stanchions 108 and 110. The stanchions 108 and 110 indirectly support the member 104 via brackets 174 and 176 that are attached to the stanchions 108 and 110 via hooks that are inserted into upper slots formed in the stanchions. The member 104 is attached to the brackets 174, 176 via screws.

Figure 10:
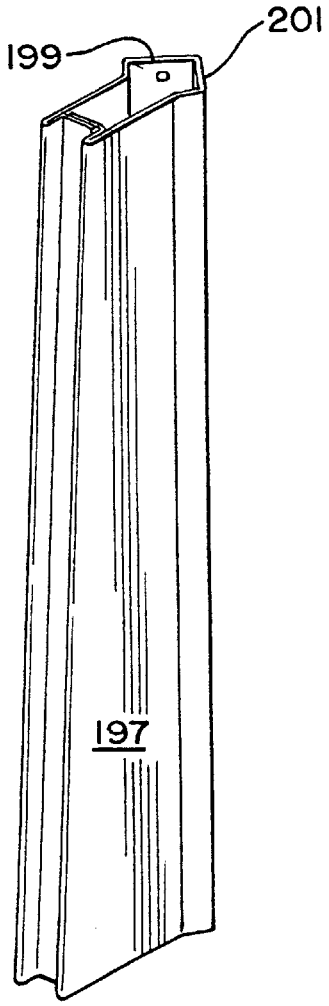
FIG. 10 is a perspective view of a corner stanchion that is used with the modular desk of FIG. 1 and is manufactured by a system and process according to the present invention.
Figure 11:
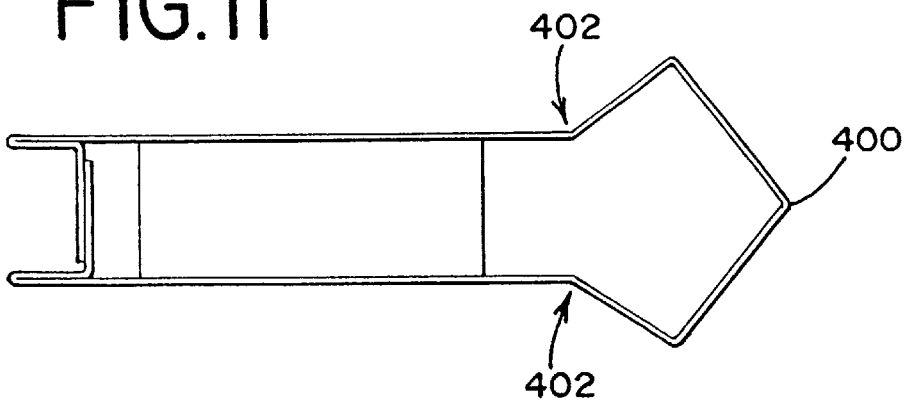
FIG. 11 is a bottom view of the corner stanchion of FIG. 10.

As shown in FIGS. 10 and 11, the corner stanchion 197 has the same basic trapezoidal shape as the stanchions 108, 110. The corner stanchion 197 is oriented at 45° with respect to the rear edges of the two sections of the L-shaped worksurface member 104 and supports the member 104 via a pair of brackets. The sides 199 and 201 of the stanchion 197 are perpendicular to one another and have slots in the same positions as the slots of the stanchions 108, 110 so as to attach brackets and leg supports thereto in the same manner that the brackets and leg supports are attached to the stanchions 108, 110 as described in U.S. Provisional Patent Application 60/086,991, filed on May 28, 1998 and PCT Patent Application No. PCT/US99/11105, filed on May 19, 1999, the entire contents of both of which are hereby incorporated herein by reference.

Once the stanchions 108, 110 and 197 are attached to the worksurface member 104 a number of components can be added to the modular desk as explained in U.S. Provisional Patent Application 60/086,991, filed on May 28, 1998 and PCT Patent Application No. PCT/US99/11105, filed on May 19, 1999, the entire contents of both of which are hereby incorporated herein by reference. For example, privacy screens 236, upper stanchions 248, and a storage cabinet 242 may be attached to the modular desk 100 as shown in FIG. 1.

Figure 12:
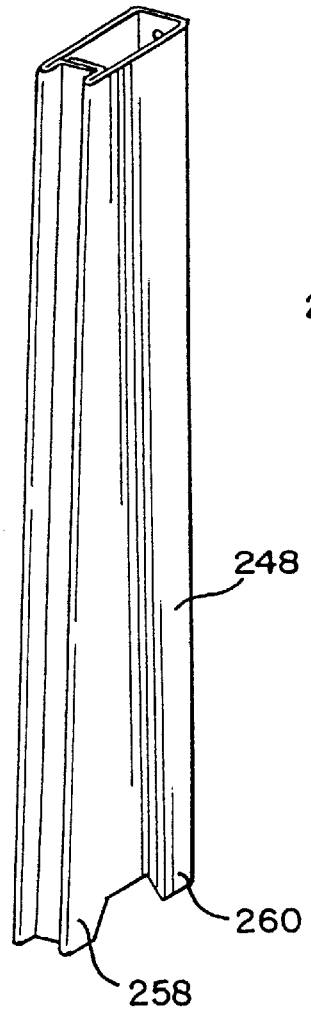
FIG. 12 shows a perspective view of an embodiment of an upper stanchion that is used with the modular desk of FIG. 1 and is manufactured by a system and process according to the present invention.
Figure 13:
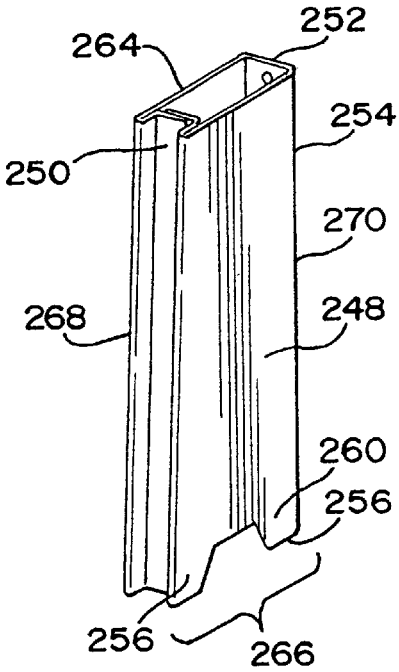
FIG. 13 shows a perspective view of a second embodiment of an upper stanchion that is used with the modular desk of FIG. 1 and is manufactured by a system and process according to the present invention.

As shown in FIGS. 12 and 13, upper stanchions 248 may have a variety of heights. The upper stanchions 248 of FIG. 13 is used to support a shelf while the upper stanchion 248 of FIG. 12 is used to support a storage cabinet 242. Each of the stanchions 248 has a front surface 250 that has the same shape as the front surface of the floor stanchions 108, 110 and rises at an obtuse angle of approximately 93.5° relative to a top stanchion surface 252 of the upper stanchion 248. The front surface 250 and the rear surface 254 are integrally attached to the top stanchion surface 252 that is parallel to a bottom stanchion surface 256. The upper stanchion 248 has a trapezoidal-like shape in that it has two lower legs 258, 260 and a pair of trapezoidal indentations 262 that define the bottom stanchion surface 256 that is adjacent to and parallel to the top section surface of the floor stanchion 108, 110 and is parallel to the top stanchion surface 254 of the upper stanchion 248.

Figure 14B:
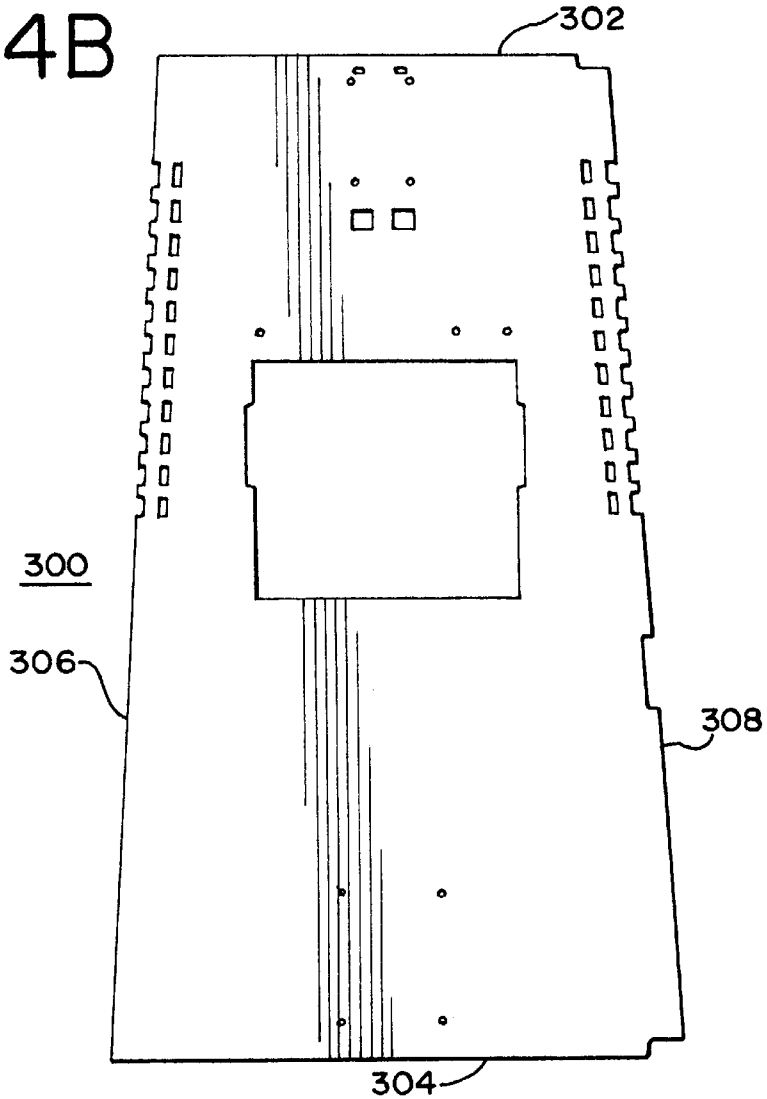
FIG. 14B shows a top view of a blank used to form the stanchion of FIGS. 10 and 11.
Figure 14A:
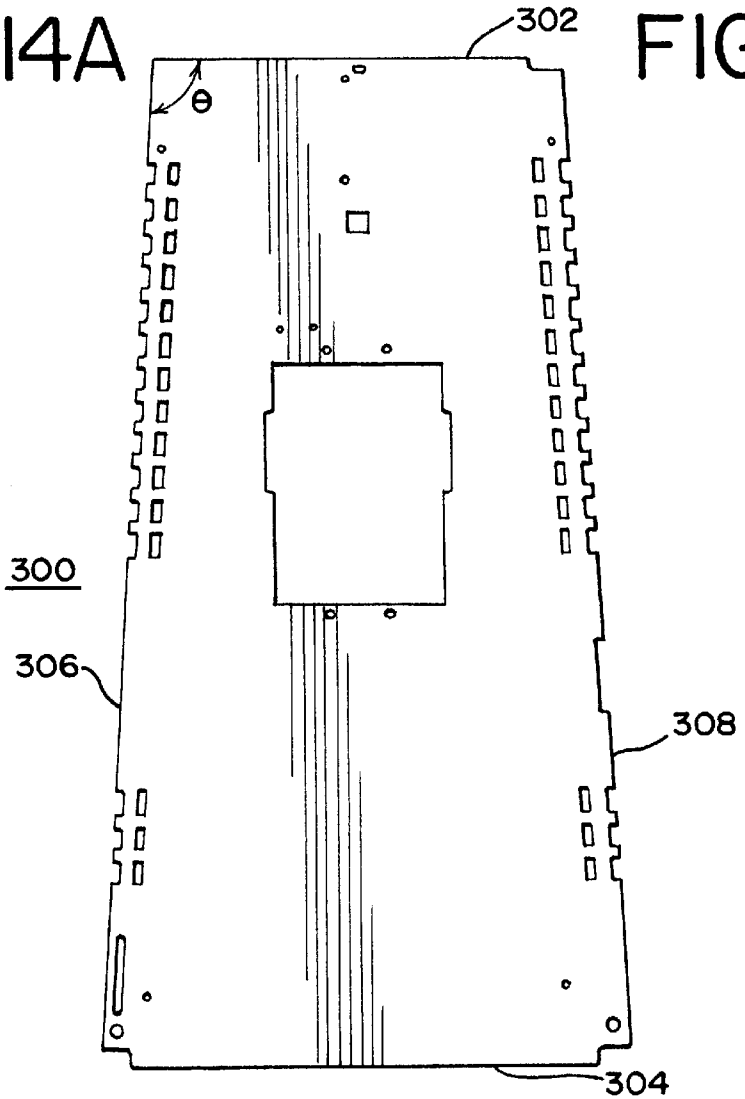
FIG. 14A shows a top view of a blank used to form the stanchion of FIGS. 3–9 and 12–13.

The stanchions 108 and 110 are formed from a one-piece blank of sheet metal 300 having a trapezoidal shape as shown in FIG. 14A. The blank 300 has a top edge 302 having a length of approximately 12.243 inches, a base edge 304 having a length of approximately 15.833 and a pair of side edges 306, 308 with identical lengths of approximately 29.951 inches. The side edges 306, 308 form an angle 2 of approximately 93.5 degrees with respect to the top edge 302.

Figure 15:
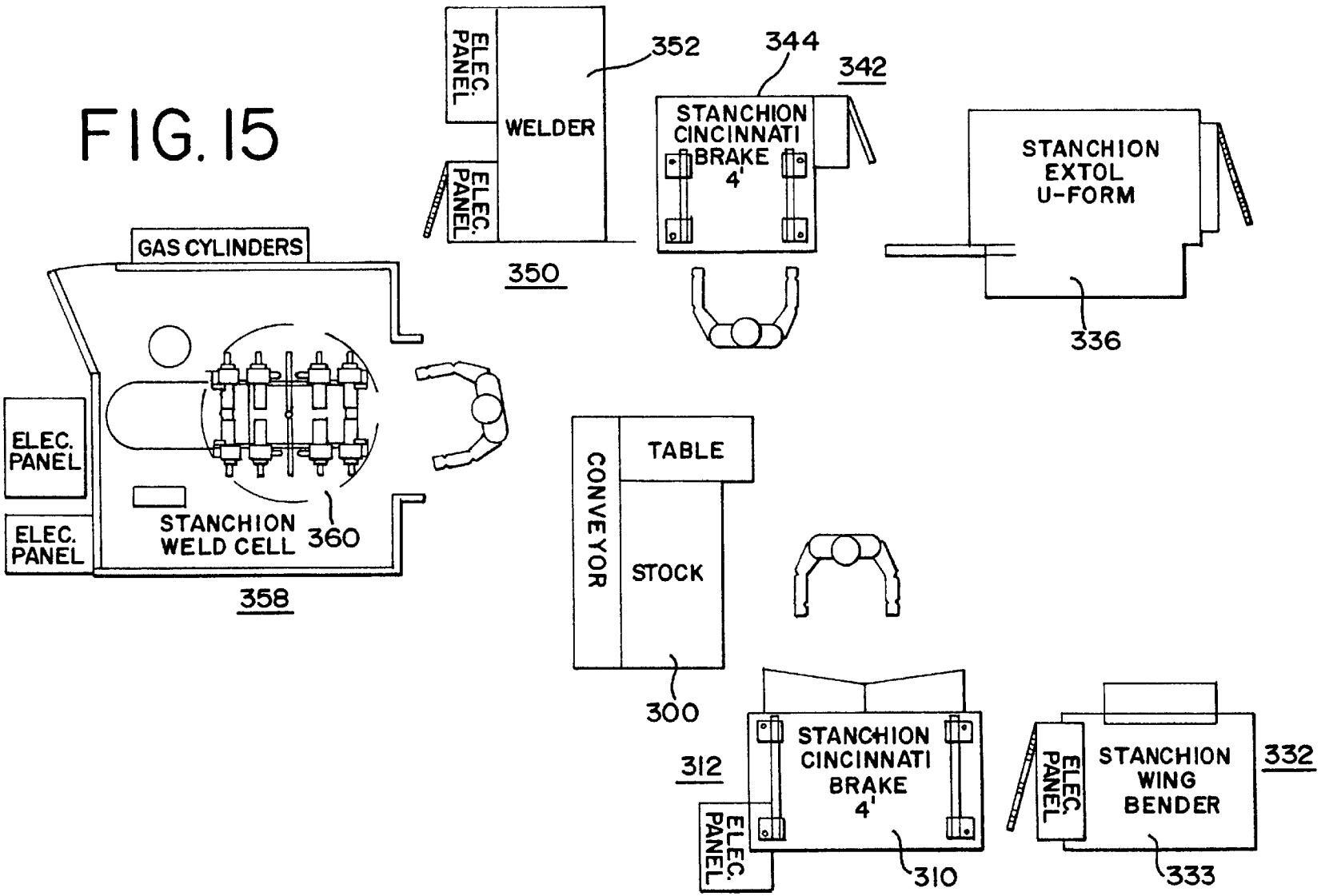
FIG. 15 schematically shows an embodiment of a system for producing the stanchions of FIGS. 3–9 and 12–13.
Figure 16:
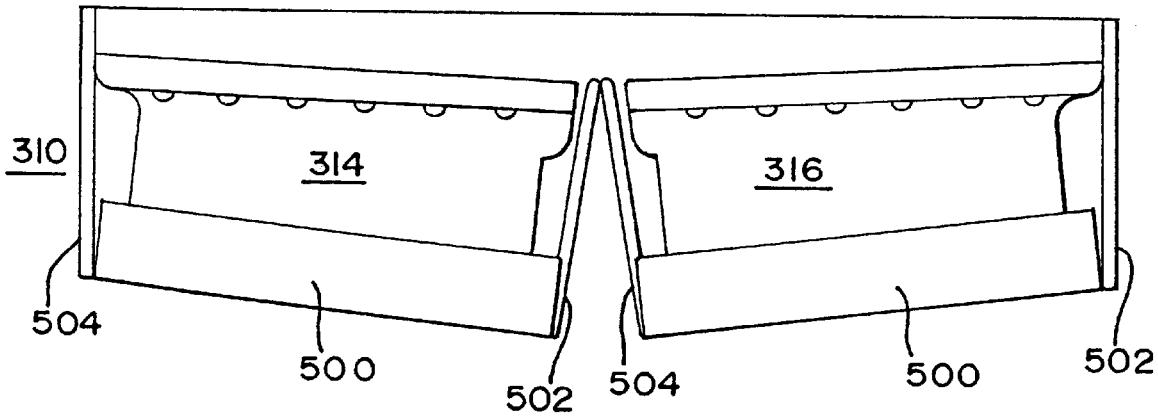
FIG. 16 schematically shows a top view of an embodiment of a braking press used in a first station of the system of FIG. 15.
Figure 17:
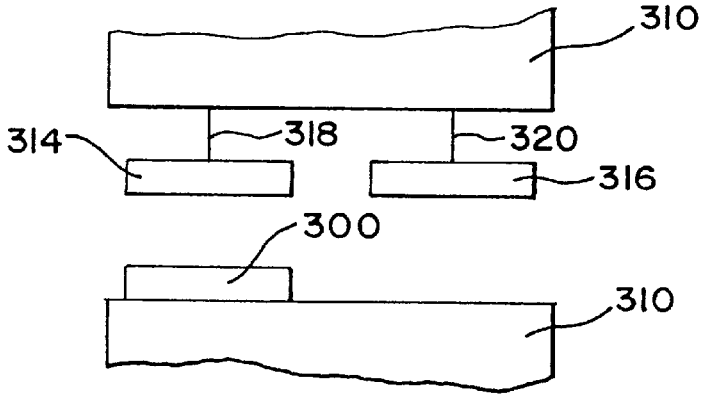
FIG. 17 shows a front, interior view of the braking press of FIG. 16.

As shown in FIG. 15, the blank 300 is taken to a single braking press 310 of a first station 312. The braking press 310 is similar to known braking presses, such as the four foot braking press made by Cincinnati Brake of Cincinnati, Ohio under Model No. 135 CBII X 6', except that the pads of the braking press at attached to the Z-break die rather than the braking press. The braking press 310 has two forming dies 314, 316 as shown in FIGS. 16 and 17 formed at the same side of the braking press 310. While each of the dies 314 and 316 have the same cross-sectional shape, die 314 is angled to lie parallel to side edge 306 and die 316 is angled to lie parallel to side edge 308. The gauging of the blank 300 in a proper position within the braking press is done by inserting one side edge into the braking press 310 and having the other side edge abut an inner edge of a raised surface. At each die, the blank 300 is packed into position by a slide 500 and the blank 300 is then held in position during the process by a pair of cylinders 502, 504. A plunging element 318 having the die 314 attached to one thereof, then presses down on the top face of the blank 300 to press the die 314 into the blank 300. Next, the plunging element 318 is removed and the blank is rotated by 180 degrees manually and moved so that the side edge with the wing abuts the raised surface while the other side of the blank 300 is placed in the braking press 310 and below the second die 316. A second plunging element 320 having the second die 316 attached thereto then presses down on the top face of the blank 300 and presses the die 316 into the blank 300. The plunging elements 318 and 320 are preferably identical to one another.

The end product of the first station 312 is that each of the two sides of the blank 300 has L-shaped wings 322, 324. For example, L-shaped wing 322 has a first leg 326 integrally attached to the blank 300 at an acute angle with respect to the central portion 328 of the blank 300. The first leg 326 for the wing 322 has a width of approximately 0.5 inches. The second leg 330 of the wing 322 is perpendicular to the first leg 326 and has a width of approximately 0.812 inches. The other wing 324 is almost the exact mirror image of the wing 322 except that the first leg 326 has a width of approximately 0.57 inches and the second leg 330 has a width of approximately 0.925 inches.

After the wings 322 and 324 are formed, the blank 300 is moved to a second station 332 that completes the wings 322 and 324 that were formed in the first station 312. The second station 332 includes a bending machine 333 as shown in FIGS. 19A–B that includes a pivoting arm 335. The blank 300 with one of its wings 322 or 324 is placed in the second station 332 so that the blank 300 faces upward so that the free end of the inserted wing points upward. Once the wing is in position, a light sensor 334 of the second station 332 gages the blank 300 and senses which wing of the blank 300 is in the second station 332. This is possible because the blank 300 has a trapezoidal shape and so the edge E1 or E2 will taper in opposite directions when placed in the second station 332. The sensor 334 can determine the direction of taper and tell which of the edges E1 and E2 are present. Once the edge and its respective wing have been identified, the wing is bent by pinching the leg 326 toward the central portion 328 under the conditions that if the edge E1 is detected then the wing 322 is under bent and if the edge E2 is detected then the wing 324 is over bent. A pivoting arm 335 of the second station 332 pinches the first leg 326 against a die block 506 by an amount based on which edge E1 or E2 is detected by the sensor 334. After the wing is bent following the above conditions, then the blank 300 is rotated by 180 degrees and the sensor 334 detects the other edge and wing and bends the wing according to the conditions stated above. The final product of the second station 332 is shown in FIG. 18B.

Figure 18A:
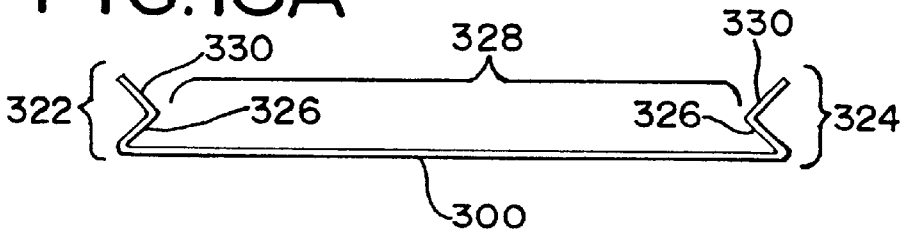
FIGS. 18A–18F show various stages of forming the stanchions of FIGS. 3–9 and 12–13 using the system of FIG. 15.
Figure 18B:
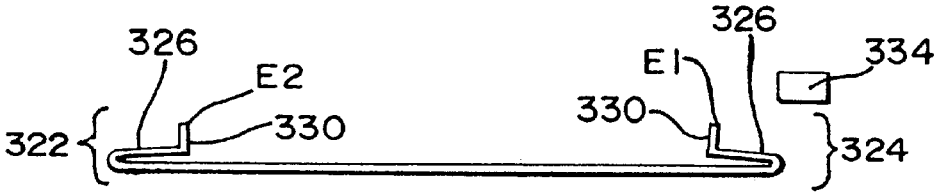
Figure 19A:
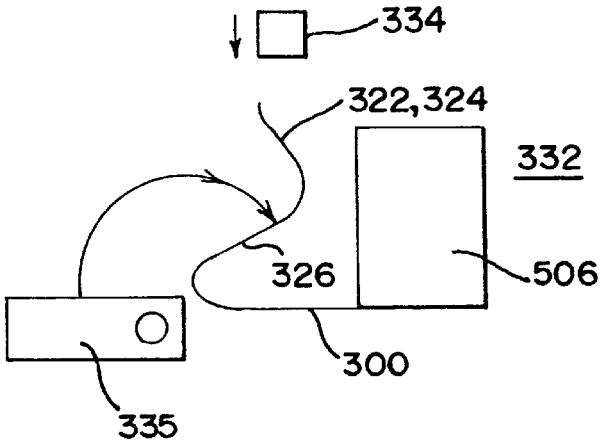
FIG. 19A schematically shows a side view of a wing bender to be used with the system of FIG. 15.
Figure 19B:
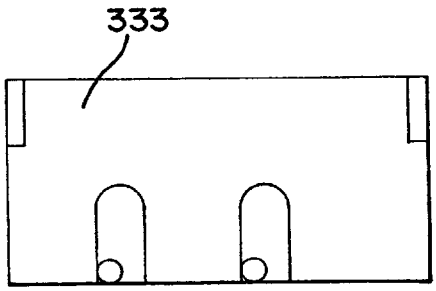
FIG. 19B schematically shows a top view of the wing bender of FIG. 19A.

As shown in FIG. 18B, an over bending means that the leg 326 is bent below horizontal and under bending means the leg 326 is bent above horizontal. Because the blank 300 will be formed into a "U" shape in later stations, the inner return flange formed by the wing 324 needs to be slightly over bent, and the outer return flange formed by the wing 322 needs to be slightly under bent. This is so that the inner and outer return flanges will not crash into each other when the blank 300 is formed into the final shape.

The end product of the second station 332 is that the two sides of the blank 300 have wings 322, 324 that are slightly under bent and over bent, respectively, as described above. In addition, the second legs 330 of the wings 322 and 324 remain perpendicular to the legs 326 of the wings.

Figure 18C:
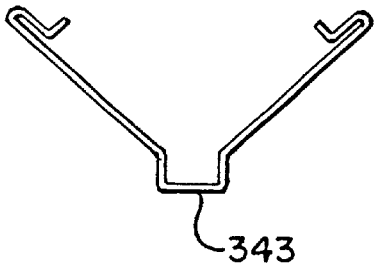
Figure 18D:
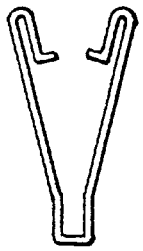
Figure 20A:
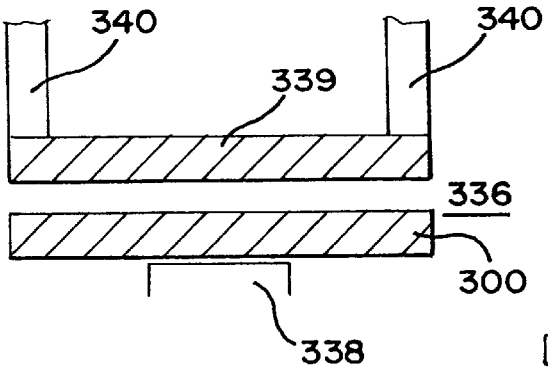
FIG. 20A schematically shows a side cross-sectional view of a third station to be used with the system of FIG. 15.
Figure 20B:
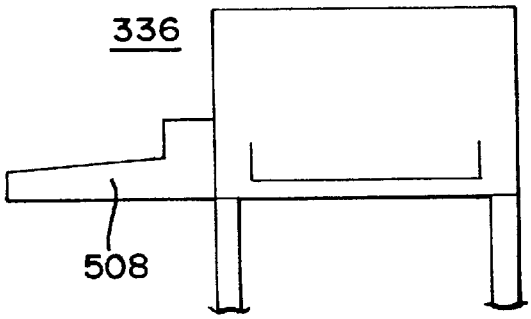
FIG. 20B schematically shows an exterior side view of the third station of FIG. 20A.

The blank 300 is then taken from the second station 332 to a third station 336 shown in FIGS. 20A–B. The blank 300 is placed in the station 336 where it is gaged by a two piece gage so as to discern the type of blank 300 present in the station 336. The station 336 has a rectangular bottom ram 338 that is small enough to fit completely inside of an opposing rectangular indentation formed in an upper die 339 that is supported by two upper rams 340. The upper rams 340 move up and down to move the upper die 339 toward or away from the blank 300 and the bottom ram 338. In operation, the upper rams 340 and the die 339 push down on the blank 300 so as to partially form the blank 300 so as to have a central rectangular section 343 and angled sides as shown in FIG. 18C. Next, while the upper rams 340 are retained in their pushing positions, the bottom ram 338 rises causing the wings 322 and 324 to move toward each other to the position shown in FIG. 18D due to the extreme pressures applied while the bottom ram holds the blank 300 in position. After the forming process is complete, the upper rams 340 are retracted upwards and the bottom ram 338 raises the blank 300 so that it is ejected from the station 336 by a finger pusher (not shown) onto a shelf 508.

Figure 18E:
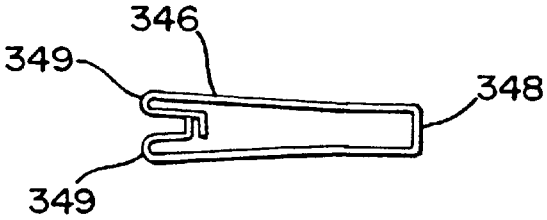
Figure 18F:
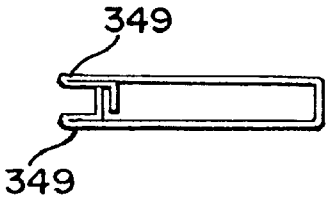
Figure 21A:
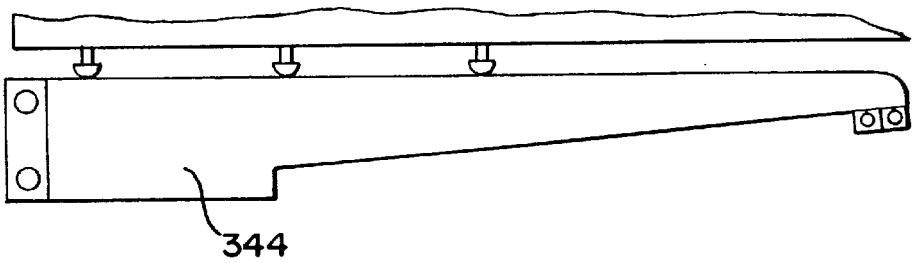
FIG. 21A schematically shows a top view of a fourth station to be used with the system of FIG. 15.
Figure 21B:
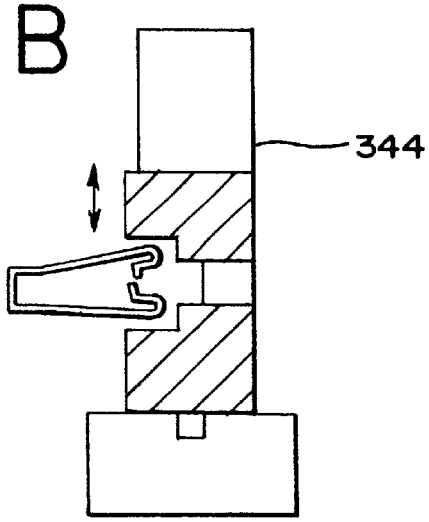
FIG. 21B schematically shows a side view of the fourth station of FIG. 21A.

The final product of the third station 336 is taken to a fourth station 342 that contains a braking press 344 as shown in FIGS. 21A–B. The braking press 344 is similar to known braking presses, such as the four foot braking press made by Cincinnati Brake of Cincinnati, Ohio under Model No. 600BII X2". The blank 300 is inserted into the braking press 344 so that the back edges 346 of each wing are above one another and are directly under the press. When the press 344 is activated, the press flattens the back edges 346 and brings the front return flanges together as shown in FIG. 18E. The blank 300 is then rotated so that the front edge 348 of the blank 300 is inserted into the press 344. The press 344 is activated and flattens the front return flanges 349 so that the blank 300 takes on the shape shown in FIG. 18F.

Figure 22A:
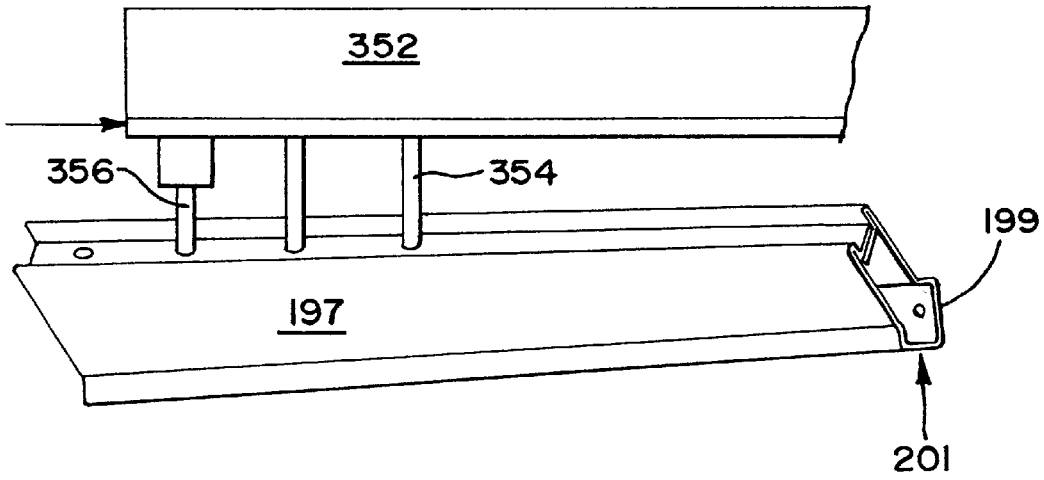
FIG. 22A schematically shows a top perspective view of a fifth station to be used with the system of FIG. 15.
Figure 22B:
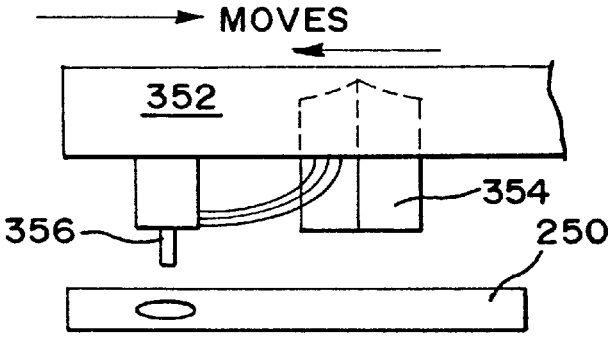
FIG. 22B schematically shows a welding mandrel and block used in the fifth station of FIG. 22A.

The formed product of the fourth station 342 is delivered to the fifth station 350 that has a welder 352 that resistance welds the return flanges together to make the blank 300 into a stanchion in the shape of a hollow tube. As shown in FIGS. 22A–B, the tube is then manually loaded into a holder so that the front surface 250 of the tube faces upward. Next, a support block 354 is placed within the channel formed in part by the front surface 250. A sensor (not shown) identifies the type of tube at the fifth station. Based on this identity, the welder 352 moves forwards (see arrow) causing the support block 354 to guide the welder 352 and a welding mandrel 356 along the front surface 250. As the welding mandrel 356 moves along the surface 250, it welds the tube at a plurality of positions according to a predetermined program based on the type of tube previously identified by the sensor. Once the welding cycle is complete, the support block 354 and the mandrel 356 are removed and the welded tube is taken to a sixth station 358.

The sixth station 358 has a robot that takes the welded tube and installs all of the needed mounting hardware as described in U.S. Provisional Patent Application 60/086,991, filed on May 28, 1998 and PCT Patent Application No. PCT/US99/11105, filed on May 19, 1999, the entire contents of both of which are hereby incorporated herein by reference. The operator then inserts all of the needed plates and hardware, and loads the assembly into a welding fixture 360, such as the Motoman SK6 mig-welding robot made by the Motoman Company, where the welding fixture welds on the hardware.

Figure 23:
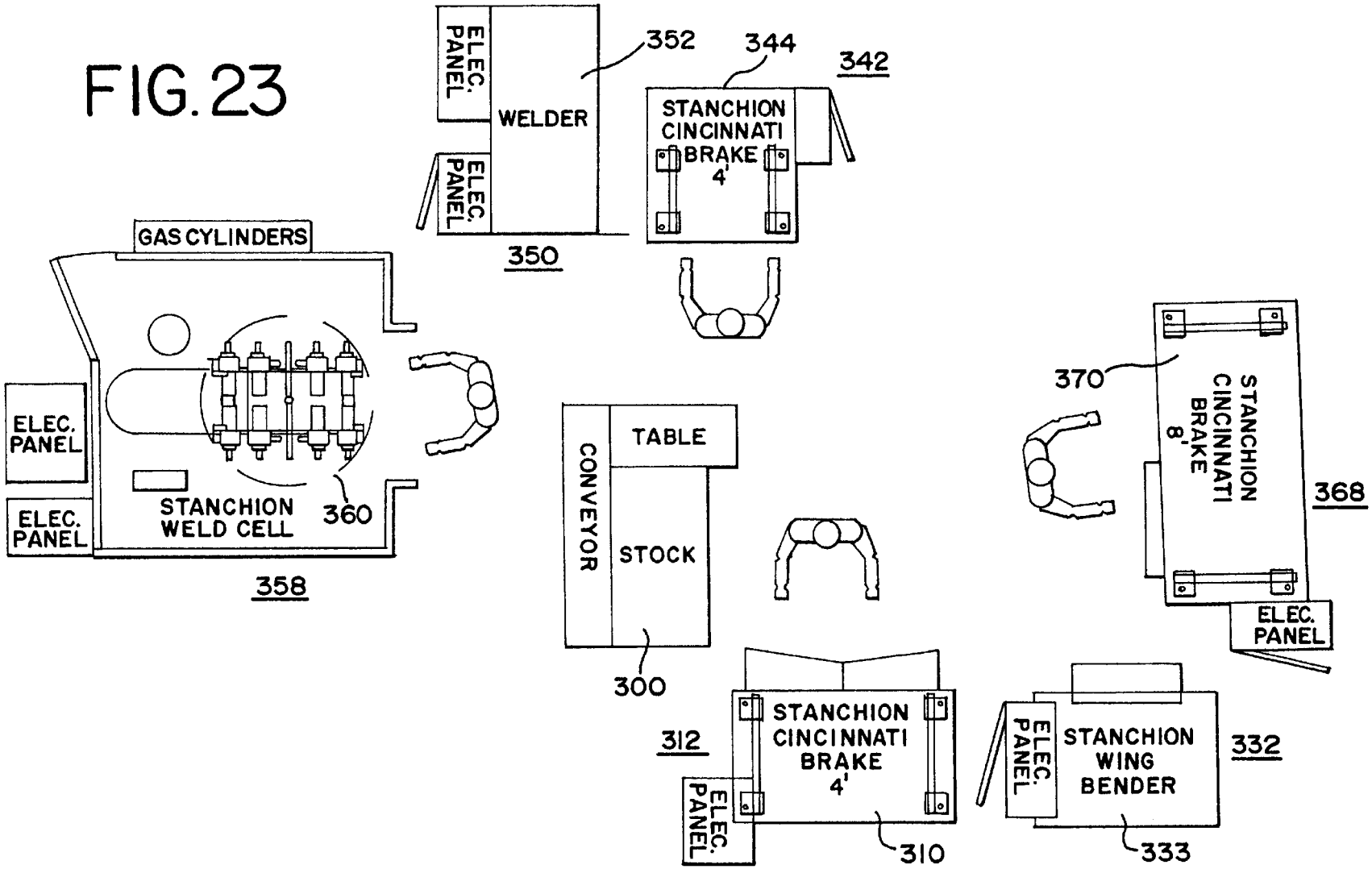
FIG. 23 schematically shows an embodiment of a system for producing the stanchion of FIGS. 10 and 11.
Figure 24A:
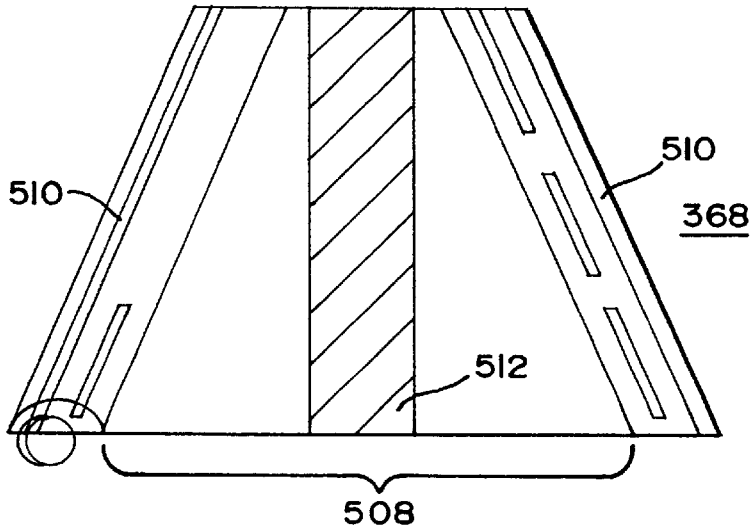
FIG. 24A schematically shows a top view of a first portion of a third station to be used with the system of FIG. 23.
Figure 24B:
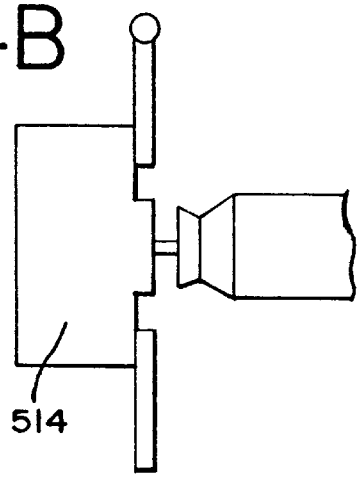
FIG. 24B schematically shows a side view of the first portion of the third station of FIG. 24A.
Figure 24D:
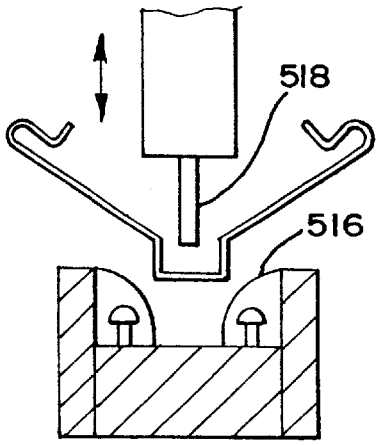
FIG. 24D schematically shows a side view of the second portion of the third station of FIG. 24A.
Figure 24C:
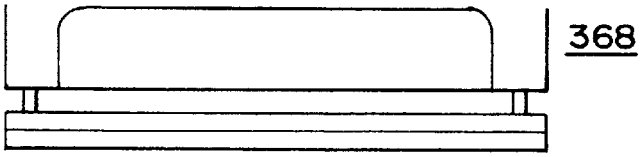
FIG. 24C schematically shows a front view of a second portion of the third station of FIG. 24A.
Figure 25A:
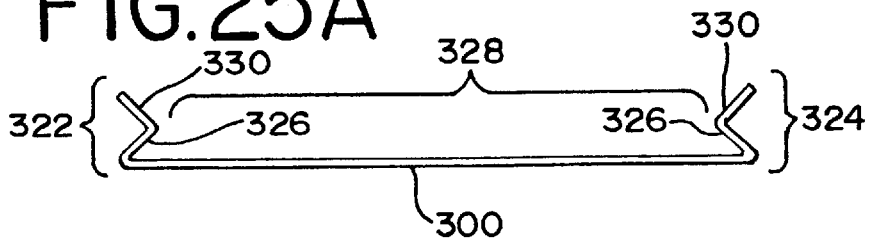
FIGS. 25A–25F show various stages of forming the stanchion of FIGS. 10 and 11 using the system of FIG. 23.
Figure 25B:
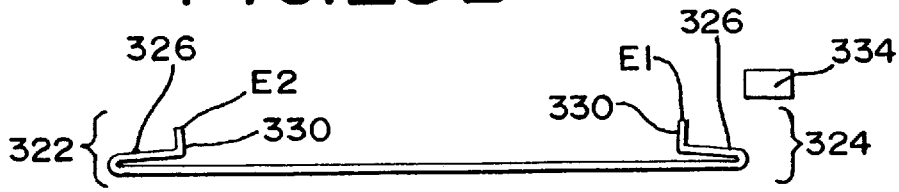
Figure 25C:
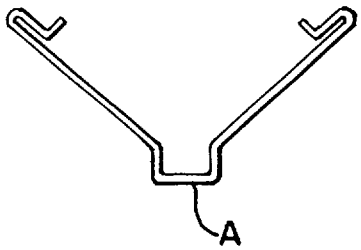
Figure 25D:
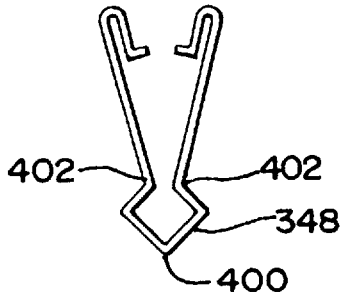
Figure 25E:
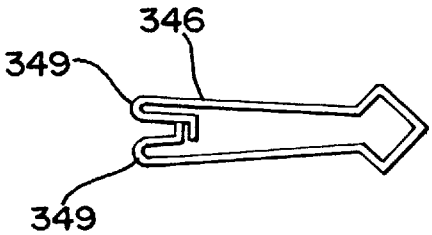
Figure 25F:
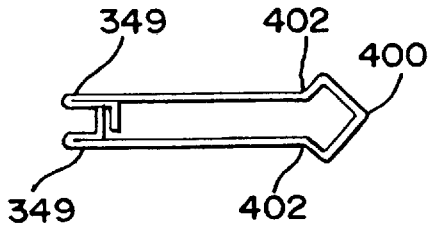

The above-described process for the production of the stanchions 108 and 110 is similar to that used for the production of the upper stanchions of FIGS. 12 and 13 where the blank 300 is modified and can be modified for producing the corner stanchion 197. As shown in FIG. 23, the modified process for producing the corner stanchion 197 involves taking the blank 300 of FIG. 14B that has approximately the same exterior edge dimensions as the blank 300 of FIG. 14A and have the blank repeat the process through the first two stations as described previously. The blank 300 is then taken to a station 368 instead of the station 336 mentioned previously. At station 368, there is a braking press 370 as shown in FIGS. 24A–D that is similar to known braking presses, such as the eight foot braking press made by Cincinnati Brake of Cincinnati, Ohio under Model No. 175 CBII X 6'. As shown in FIG. 26C, a first portion of the braking press 370 (see FIGS. 24A–B) squares off the corner 400 (see FIG. 11) by placing the blank 300 flat on the surface 508 between the angled constraints 510 so that a middle portion of the blank 300 lies over a die 512. Once positioned, an upper ram 514 presses down on the blank 300 so as to form the blank of FIG. 25C with a rectangular central portion A. Then the blank 300 is repositioned in a second portion of the braking press 370 so that the central portion A lies above a die 516 (see FIGS. 24C–D). An upper ram 518 then presses the central portion A into the die 516 to form the corner 400 and the corner details 402 shown in FIGS. 11 and 25D.

Once the blank 300 has completed the process at the station 368, the blank 300 is processed sequentially by the remaining stations 342, 350 and 358 in the same manner as described previously. The various forms of the blank 300 as it passes through the various stations are shown in FIGS. 25A–F.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

I claim:

1. A process for forming a support, comprising:

providing a blank with a first edge and a second edge;

forming a first wing at said first edge and a second wing at said second edge, wherein said first wing comprises; a first leg with a free end; and a second leg attached to said first leg and a first portion of said blank that does not include said first edge, said second leg lies substantially parallel to a second portion of said blank that is exclusive of said first wing and said second wing;

folding said first wing toward said second wing about an axis that is parallel to said first edge; and attaching said first wing to said second wing.

2. The process of claim 1, wherein said support is in the shape of a trapezoid.

3. The process of claim 1, wherein said blank is in the shape of a trapezoid.

4. The process of claim 2, wherein said blank is in the shape of a trapezoid.

5. The process of claim 1, wherein forming said first wing comprises pressing a first side of said blank into a die.

6. The process of claim 1, wherein forming said first wing comprises sensing the presence of said first wing.

7. The process of claim 6, wherein said sensing comprises detecting a direction of taper of an edge of said blank that is associated with said first wing.

8. The process of claim 1, wherein said first wing is L-shaped.

9. The process of claim 1, wherein said first wing is under bent and said second wing is over bent.

10. The process of claim 1, wherein said first wing does not interfere with said second wing as said first wing is folded toward said second wing.

11. The process of claim 9, wherein said first wing does not interfere with said second wing as said first wing is folded toward said second wing.

12. The process of claim 1, wherein said second wing comprises:

a third leg with a free end; and a fourth leg attached to said third leg and a third portion of said blank that does not include said second edge, said fourth leg lies substantially parallel to a fourth portion of said blank that is exclusive of said first wing and said second wing.

* * * * *

UNITED STATES PATENT AND TRADEMARK OFFICE

CERTIFICATE OF CORRECTION

PATENT NO. : 6,609,285 B1
DATED : August 26, 2003
INVENTOR(S) : Daniel R. Kinney It is certified that error appears in the above-identified patent and that said Letters Patent is hereby corrected as shown below:

Column 8,
Line 5, immediately after "comprises" delete ";" and substitute -- : -- in its place.

Signed and Sealed this

Thirteenth Day of July, 2004

JON W. DUDAS
*Acting Director of the United States Patent and Trademark Office*